United States Patent [19]

Martikainen

[11] 4,267,717

[45] May 19, 1981

[54] DISC CYLINDER LOCK

[75] Inventor: Kaarlo Martikainen, Joensuu, Finland

[73] Assignee: Oy Wartsila Ab, Helsinki, Finland

[21] Appl. No.: 94,105

[22] Filed: Nov. 14, 1979

[30] Foreign Application Priority Data

Nov. 17, 1979 [FI] Finland ..... 783510

[51] Int. Cl.[3] ..... E05B 29/02

[52] U.S. Cl. ..... 70/366; 70/377

[58] Field of Search ..... 70/366, 365, 362, 357, 70/377, 376, 353, 355

[56] References Cited

U.S. PATENT DOCUMENTS 2,217,047 10/1940 Fitzgerald ..... 70/366

*Primary Examiner*—Robert L. Wolfe

*Attorney, Agent, or Firm*—McAulay, Fields, Fisher, Goldstein & Nissen

[57] ABSTRACT

A cylinder lock comprising a fixed, hollow cylinder housing and therein a plurality of tumbler discs turnable by means of the key of the lock. Each tumbler disc has a peripheral recess, and there is a locking bar extending axially relative to the locking discs and being radially guided by them when moving between an outer locking position and an inner releasing position. There is also a turnable force-transmission member non-turnably connected to the locking bar. Between the locking discs, there are spacer discs, each provided with a peripheral recess at the position of the locking bar. This recess is so formed, that it guides, in the tangential direction of the spacer discs, the radial movement of the locking bar. The locking discs as well as the spacer discs are turnably guided and radially supported directly by the internal surface of the cylinder housing. The locking discs, the spacer discs and the locking bar have guiding surfaces acting in a tangential direction of the lock. These surfaces provide a tangential locking of the spacer discs relative to the locking bar in all functional positions of the lock as well as fixed limits for the movability range of the locking discs relative to the locking bar and means for obtaining a force transmission from the locking discs to the locking bar at the limits of the movability range of the locking discs.

6 Claims, 11 Drawing Figures

DISC CYLINDER LOCK

Figure 1:
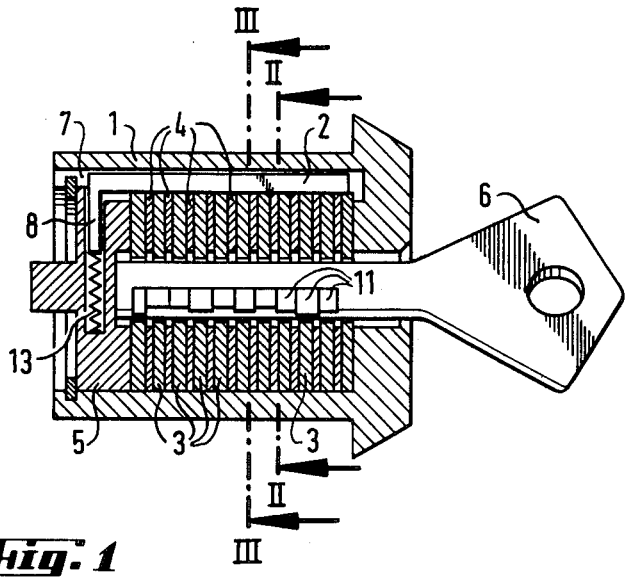

The invention relates to a cylinder lock comprising a fixed, hollow cylinder housing and therein a plurality of tumbler discs turnable by means of the key of the lock and provided with a peripheral recess, a locking bar extending axially relative to the locking discs and being radially guided by them, and a turnable force transmission member non-turnably connected to the locking bar.

The disc cylinder lock with turnable locking discs is the most secure of all known cylinder lock types. Yet, one of its drawbacks is that the lock cannot be given very small diametrical dimensions, because the elements of the lock mechanism require a certain space in the radial direction of the lock. In a conventional disc cylinder lock, there is a fixed cylinder housing and therein a turnable cylinder and locking discs fitted in the interior of the cylinder. It has been discovered, that that hollow part of the cylinder, which encloses the locking discs, is not absolutely necessary. Locks without this part are known, for instance, the lock shown in U.S.A.-patent publication 2,217,047. However, this known lock differs considerably from known disc cylinder locks, among other things, in that each of its locking discs is guided by a separate groove made in the cylinder housing of the lock. The use of such guiding grooves requires, firstly, that the cylinder housing of the lock is divided at an axial plane in two parts, due to which the cylinder housing will be weak and at same time complicated and expensive. Secondly, the function of the known lock is extremely unreliable, because there is no member pushing the locking bar outwards to its locking position. For these reasons the lock is not able to fulfill the requirements of a security lock, but new and more practical solutions must be found to make it possible to dispense with a part of the cylinder.

The object of the invention is to create a disc cylinder lock having a reliable function as being as uncomplicated as possible, which lock is cylinderless in the sense that that part of a conventional cylinder has been left out, inside which the locking discs are usually fitted. The invention is characterized by the combination that, between the locking discs, there are, as knwon per se, spacer discs provided with a peripheral recess at the position of the locking bar, which peripheral recess is so formed, that it guides, in the tangential direction of the spacer discs, the radial movement of the locking bar of the lock, that the locking discs as well as the spacer discs are turnably guided and radially supported directly by the internal surface of the cylinder housing, and that the locking discs, the spacer discs and the locking bar have guiding surfaces acting in a tangential direction and so arranged that by means of them a tangential locking of the spacer discs relative to the locking bar is obtained in all functional positions of the lock, as well as a limited movability of the locking discs relative to the locking bar and the necessary force transmission at the limits of said movability range. The function of a lock of this kind is as secure and reliable as the function of a conventional disc cylinder lock, but the lock can be made with smaller outer dimensions than a normal lock. The construction makes it possible to insert the disc set of locking and spacer discs in an axial direction into the cylinder housing, because it is not necessary to provide the internal surface of the cylinder housing with guiding grooves for the locking discs nor with guiding elements for the spacer discs. Hence, the cylinder housing does not have to be divided axially, which simplifies and strengthens the lock construction.

In a lock according to the invention, said guiding surface acting in a tangential direction can with advantage be arranged by providing several locking discs with a peripheral recess having a narrow, deep part and a broad, shallow part, and being so arranged, that the locking bar moves partly into the narrow, deep part when the lock mechanism is released. The shallow and considerably broader part determines the freedom of turning of the locking disc in question relative to the locking bar and prevents the locking bar from entering into said deep part until the deep parts of all locking discs have been brought to the position of the locking bar by means of the key of the lock. By this means, the necessary guiding of the locking bar is obtained in a simple way and the function of the lock will be secure and reliable.

Said tangentially acting guiding surfaces can also be arranged so that the radial dimension of the locking bar at least at the position of some locking discs is made smaller than at the position of the spacer discs. In this case, only a narrow peripheral recess is needed at the position of those locking discs where the radial dimension of the locking bar is small. Nevertheless, it is recommendable that there is a locking disc provided with two combined peripheral recesses at least at the outer end of the lock, preferably at its both ends, whereby the radial dimension of the locking bar at these positions is to be greater than at the position of the locking discs having only one peripheral recess. The locking discs at both ends of the disc set of the lock can with advantage work as so called lifting locking discs lifting the locking bar up from the channel formed by the peripheral recesses of the locking discs when the disc set of the lock is turned by the key in the locking direction. If said arrangement is used only at the outer end of the locking bar, that is, at that end at which the key is inserted in the lock, its opposite end can be loaded radially outwards by means of a spring.

In a lock according to the invention, the turning angle of the locking discs relative to the locking bar can be limited by means of the side edges of said broad peripheral recess. It is not necessary to limit the turning angle of all the locking discs. There is also another solution providing means for limiting easily the turning angle of all the locking discs in both directions and means for guiding the spacer discs as well. According to this solution, the spacer discs are non-turnably locked relative to the locking bar by means of a separate element connected to said force transmission member, which element may be an axially disposed bar or tongue connected to said force transmission member, which bar or tongue at the same time may function as a member locking the turning movement of the spacer discs and limiting the turning movement of the locking discs. The suggested solution presupposes that the locking discs are provided with a second peripheral recess or with other suitable guiding surfaces for said bar or tongue.

Figure 2:
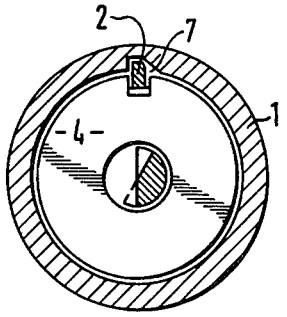
Figure 3:
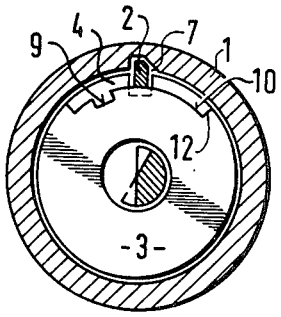
Figure 4:
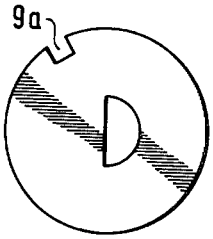
Figure 5:
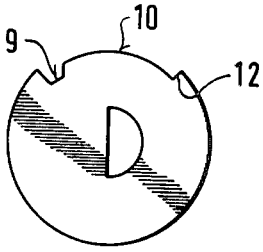
Figure 6:
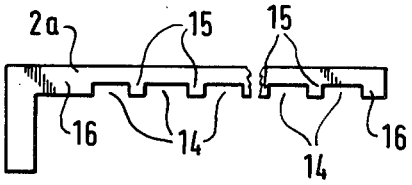
Figure 7:
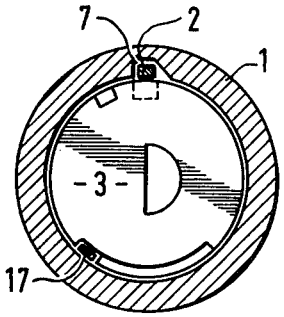
Figure 8:
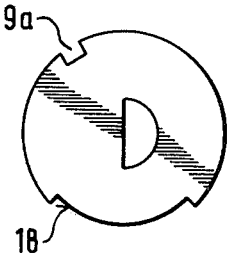
Figure 9:
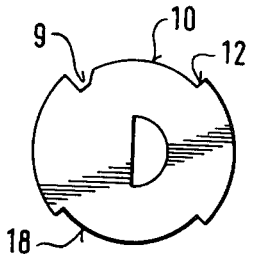
Figure 10:
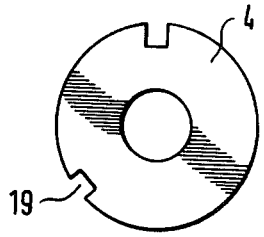
Figure 11:
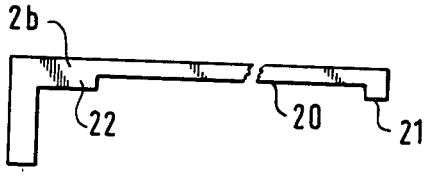

In the following, the invention will be described with reference to the attached drawings, in which FIG. 1 shows a longitudinal section of a lock according to the invention, FIG. 2 shows section II—II of FIG. 1, FIG. 3 shows section III—III of FIG. 1, FIG. 4 shows a locking disc of a second embodiment, FIG. 5 shows a so called lifting locking disc for the same second embodiment, FIG. 6 shows the locking bar of said second embodiment, FIG. 7 shows a cross section of a lock according to a third embodiment, FIG. 8 shows a locking disc for a lock according to FIG. 7, FIG. 9 shows a so called lifting locking disc for a lock according to FIG. 7, FIG. 10 shows a spacer disc for a lock according to FIG. 7, and FIG. 11 shows a locking bar for a lock according to FIG. 7.

In the drawing, numeral 1 indicates the cylinder housing of a lock, 2 the locking bar of the lock, 3 the locking discs of the lock, 4 spacer discs between the locking discs, 5 a force transmission member at the rear end of the lock and 6 the key of the lock. FIG. 2 shows that locking bar 2 is, in its locking position, partly located in an axial groove 7 made in the cylinder housing 1 of the lock. When the lock is in its locking position, locking discs 3 prevent locking bar 2 from leaving groove 7, and thereby, a radial portion 8 of the locking bar locks also the turning movement of force transmission member 5. At the same time, locking bar 2 functions as a locking member for spacer discs 4 and prevents their turning movement.

FIG. 3 shows the form of locking discs 3. The locking discs have a deep peripheral recess 9 and a shallow, but considerably broader peripheral recess 10. Combination surfaces 11 in key 6 (FIG. 1) bring, when the key is turned in the opening direction of the lock, each locking disc to such a position, that deep peripheral recess 9 takes a position at locking bar 2, whereby a continuous channel is formed below the locking bar, into which channel locking bar 2 may move, being thereby released from its locking groove 7. When the locking bar has been released in this way, the disc set composed by locking spacer discs and at the same time also the force transmission member 5 of the lock can be turned in the opening direction of the lock. The side edges of broad peripheral recess 10 of the locking discs determine the freedom of movement of the locking discs relative to the locking bar. For obtaining a lifting of locking bar 2 a locking bar lift spring 13, shown in FIG. 1, is used, but in addition to the spring, a so called liftinglocking disc is needed, at least at the opposite end of the locking bar, that is, at its outer end. If there is no mechanism taking care of the lifting of the locking bar, the turning of the lock back to its locking position will not stop when the locking bar reaches the position of locking groove 7, whereby the key cannot be withdrawn from the lock.

FIG. 4 shows a locking disc of another embodiment, slightly differing from the above shown embodiment, which locking disc does not function as so called lifting locking disc. This locking disc has only a narrow peripheral recess 9*a* and no broad peripheral recess. The use of this kind of locking disc is, however, possible only when the radial dimension of locking bar 2 has been, as shown at positions 14 in FIG. 6, reduced by removing from the locking bar, at the position of the non-lifting locking discs, that part of the locking bar which would be left outside of the locking groove 7. At the positions 15 of the locking bar, there are spacer discs and at the positions 16 lifting locking discs. A lifting locking disc is shown in FIG. 5. It has both a narrow peripheral recess 9 and a broad peripheral recess 10.

The lock type shown in FIGS. 7-11 differs from the lock types described above in that a separate bar or tongue 17, which is used as a member limiting the turning movement of the locking discs and locking the spacer discs, is axially disposed in the lock extending from the force transmission member 5. Also in this lock type the non-lifting locking disc shown in FIG. 8 has only a narrow peripheral recess 9*a* for the locking bar, but in addition it has a separate broad peripheral recess 18, the object of which it to determine the freedom of turning of the locking disc by means of the tongue 17. The lifting locking disc shown in FIG. 9 corresponds completely to the lifting locking discs shown FIG. 5. The only difference is that this locking disc, of course, has to have the same kind of additional broad peripheral recess 18 as in the locking disc shown in FIG. 8.

The spacer disc 4 shown in FIG. 10 corresponds completely to the spacer discs of the other lock types described, but also this disc has an additional peripheral recess 19, which corresponds to the width of member 17 and prevents turning of the spacer disc relative to the locking bar. In FIG. 19 a locking bar 2*b* has been shown, from the middle part 20 of which the portion exceeding the depth of the locking groove 7 has been removed. At least at one end of the locking bar, at position 21, but preferably also at its other end, at position 22, there is a lifting locking disc according to FIG. 9. In other respects the function of the locking bar and the way it is fitted in the lock corresponds completely to the function and way of fitting of the previously described locking bars.

The invention is not limited to the embodiments shown, but several modifications of the invention are feasible within the scope of the attached claims.

I claim:

1. A cylinder lock comprising a fixed, hollow cylinder housing and therein a plurality of tumbler discs turnable by means of the key of the lock, each tumbler disc having a peripheral recess, a locking bar axially disposed in said lock and being guided by said locking discs in a radial direction of the lock, said locking bar being movable between an outer, locking position and an inner, releasing position, and further, a turnable force-transmission member non-turnably connected to said locking bar, wherein the improvement consists in the combination, that between said locking discs, there are, in a manner known per se, spacer discs provided with a peripheral recess at the position of said locking bar, said peripheral recess being formed to give said locking bar lateral guidance when it is moved between said two positions, that said locking discs as well as said spacer discs are turnably guided and radially supported directly by the internal surface of said cylinder housing, and that said locking discs, said spacer discs and said locking bar have guiding surfaces acting in a tangential direction of the lock, said guiding surfaces providing a tangential locking of said spacer discs relative to said locking bar in all functional positions of the lock as well as fixed limits for the movability range of said locking discs relative to said locking bar and means for obtaining a force transmission from said locking discs to said locking bar at the limits of said movability range.

2. A lock according to claim 1, in which said guiding surfaces acting in a tangential direction have been obtained by providing several of said locking discs with a combined peripheral recess having a narrow, deep part and a broad, shallow part and being so arranged that said locking bar, in its releasing position, is partly received by said narrow, deep part of said combined peripheral recess.

3. A lock according to claim 1, in which said guiding surfaces acting in a tangetial direction have been obtained by making, at least at the position of some locking discs, the dimension of said locking bar in a radial direction of the lock smaller than the corresponding dimension of the locking bar at the position of said spacer discs.

4. A lock according to claim 3, in which, in those locking discs, at the position of which said radial dimension of the locking bar is smaller than at the position of the spacer discs, there is only a narrow peripheral recess.

5. A lock according to claim 3, in which said spacer discs are non-turnably locked relative to said locking bar by means of a separate element connected to said force transmission member.

6. A lock according to claim 5, in which said separate element is a second bar or tongue axially disposed in the lock and connected to said force transmission member, which bar or tongue is arranged to lock the turning movement of said spacer discs and to limit the turning movement of said locking discs.

* * * * *